US006568776B1

(12) United States Patent
Kato

(10) Patent No.: US 6,568,776 B1
(45) Date of Patent: May 27, 2003

(54) PRINTING APPARATUS AND POWER SUPPLY LOAD REDUCTION METHOD FOR PRINTING APPARATUS

(75) Inventor: Takahiro Kato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/714,172

(22) Filed: Nov. 17, 2000

(30) Foreign Application Priority Data

Nov. 17, 1999 (JP) ..... 11-327366

(51) Int. Cl.[7] ..... B41J 25/308
(52) U.S. Cl. ..... 347/8; 347/221
(58) Field of Search ..... 347/8, 101, 16, 347/104, 215, 221, 190, 4; 400/120.1

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,349,905 A | * | 9/1994 | Taylor et al. | 102/488 |
| 5,373,312 A | * | 12/1994 | Fujioka et al. | 347/102 |
| 5,382,101 A | * | 1/1995 | Iguchi | 400/124.03 |
| 5,489,926 A | * | 2/1996 | Arbeiter | 347/16 |
| 5,717,837 A | * | 2/1998 | Asai et al. | 395/108 |
| 5,978,557 A | | 11/1999 | Kato | |

FOREIGN PATENT DOCUMENTS

| | | |
|---|---|---|
| EP | 0 917 961 | 5/1999 |
| JP | 54-56847 | 5/1979 |
| JP | 59-123670 | 7/1984 |
| JP | 59-138461 | 8/1984 |
| JP | 60-71260 | 4/1985 |
| JP | 11-188942 | 7/1999 |

* cited by examiner

*Primary Examiner*—John Barlow
*Assistant Examiner*—Ly T. Tran
(74) *Attorney, Agent, or Firm*—Fitzpatrick, Cella, Harper & Scinto

(57) ABSTRACT

In a printing apparatus having a plurality of full-line print heads each having a print element array corresponding to the width of a print medium, upon receiving print data that uses a plurality of print media, a print duty, which is the ratio of the number of nozzles used in a print process to the total number of nozzles, is computed as a numerical value that pertains to electric power to be supplied to the print heads upon printing that print data. When the computed value is larger than a predetermined value that represents electric power which can be supplied from a power supply of the printing apparatus, the distance between the plurality of print media is increased so that the numerical value that pertains to the electric power becomes equal to or smaller than the predetermined value. With this control, deterioration of image quality and extreme drop of the printing speed can be prevented without unwantedly increasing the power supply capacity.

17 Claims, 9 Drawing Sheets

PRINTING APPARATUS AND POWER SUPPLY LOAD REDUCTION METHOD FOR PRINTING APPARATUS

FIELD OF THE INVENTION

The present invention relates to a printing apparatus and power supply load reduction method for a printing apparatus and, more particularly, to a printing apparatus having a plurality of full-line print heads each having a print element array corresponding to the width of a recording medium, and a power supply load reduction method for that printing apparatus.

BACKGROUND OF THE INVENTION

As an information output device for, e.g., a wordprocessor, personal computer, facsimile apparatus, and the like, a printer that prints information such as desired characters, images, and the like on a sheet-like print medium such as a paper sheet, film, or the like is known.

Various printing schemes for printers are known. Of these schemes, an ink-jet scheme has particularly attracted a lot of attention in recent years since it can print on a print medium such as a paper sheet or the like in a non-contact manner, and can assure low running cost, a simple color structure, low noise due to a non-impact mechanism, and so forth.

Of ink-jet printing apparatuses, a full-line printing apparatus, which has a print head comprising a print element (nozzle) array corresponding to a printing region, and prints while conveying a print medium, is prevalently used since it can achieve a higher-speed print process.

Upon executing a color print process using such full-line printing apparatus, a plurality of print heads that eject different color inks line up in the convey direction of the print medium and are controlled to simultaneously eject inks, thus preventing any printing speed drop even in a color print process.

However, a printing apparatus having a full-line print head requires a power supply capacity that can simultaneously drive all nozzles of the print head since data corresponding to one raster are to be printed simultaneously.

A printing apparatus that achieves a color print process using a plurality of full-line print heads requires a still larger power supply capacity, i.e., a power supply capacity that can drive all nozzles of a plurality of print heads so as to prevent any printing speed drop.

Such increase in power supply capacity results in a large power supply unit size and an increase in manufacturing cost. As a result, the entire printing apparatus becomes bulky, and cost increases.

SUMMARY OF THE INVENTION

The present invention has been made in consideration of the above situation, and has as its object to provide a printing apparatus-which can prevent deterioration of image quality and extreme drop of the printing speed without unwantedly increasing the power supply capacity, and a power supply load reduction method for the printing apparatus.

In order to achieve the above object, a printing apparatus of the present invention is a printing apparatus having a plurality of full-line print heads each having a print element array corresponding to a width of a print medium, comprising convey means for conveying the print medium to a position where the print heads can print, print electric power computation means for computing a numerical value that pertains to electric power to be supplied to the print heads upon printing print data when print data that uses a plurality of print media is received, determination means for determining if the numerical value that pertains to the electric power is larger than a predetermined value, distance setting means for setting a distance between the plurality of print media in accordance with the determination by the determination means, and convey control means for controlling the convey means to make the distance between the print media be the distance set by the distance setting means upon conveying the plurality of print media.

Also, in order to achieve the above object, a power supply load reduction method for a printing apparatus of the present invention is a power supply load reduction method for a printing apparatus having a plurality of full-line print heads each having a print element array corresponding to a width of a print medium, comprising the convey step of conveying the print medium to a position where the print heads can print, the print electric power computation step of computing a numerical value that pertains to electric power to be supplied to the print heads upon printing print data when print data that uses a plurality of print media is received, the determination step of determining if the numerical value that pertains to the electric power is larger than a predetermined value, the distance setting step of setting a distance between the plurality of print media in accordance with the determination in the determination step, and the convey control step of controlling the convey step to make the distance between the print media be the distance set in the distance setting step upon conveying the plurality of print media.

More specifically, in a printing apparatus which has a plurality of full-line print heads each having a print element array corresponding to the width of a print medium, upon receiving print data that use a plurality of print media, a print duty or the like as the number of print elements used in a print process with respect to the total number of print elements is computed as a numerical value that pertains to electric power to be supplied to the print heads upon recording the received print data, and the computed value is compared with a predetermined value to determine a distance between neighboring print media, and the print media are controlled to be conveyed at the set print medium distance.

In this way, when a print process is continuously performed on a plurality of print media, electric power required for the print process can become equal to or smaller than an electric power capacity that the power supply equipped in the printing apparatus can supply, by changing the distance between neighboring print media. Hence, the print process on a plurality of print media can be performed while preventing deterioration of image quality and extreme drop of the printing speed without increasing the power supply capacity of the printing apparatus.

For example, when the computed value is larger than the predetermined value, the distance between the neighboring print media is increased so that the numerical value that pertains to electric power becomes equal to or smaller than the predetermined value.

As the numerical value that pertains to the electric power, a ratio of the number of print elements to be driven upon printing the print data to the number of all the print elements of the print heads is preferably used.

The distance setting means selects and sets the distance between the print media from a plurality of pre-set values, thus simplifying processes.

Note that the apparatus preferably further comprises means for changing the predetermined value in correspondence with a size of the print medium and a print region of the print data.

In this case, the apparatus preferably further comprises table creation means for storing the predetermined value corresponding to the size of the print medium and the print region of the print data.

The printing apparatus preferably further comprises memory means for storing the print data in units of pages, and the print electric power computation means computes the numerical value that pertains to the electric power when print data of the next page to be printed is stored in the memory means.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
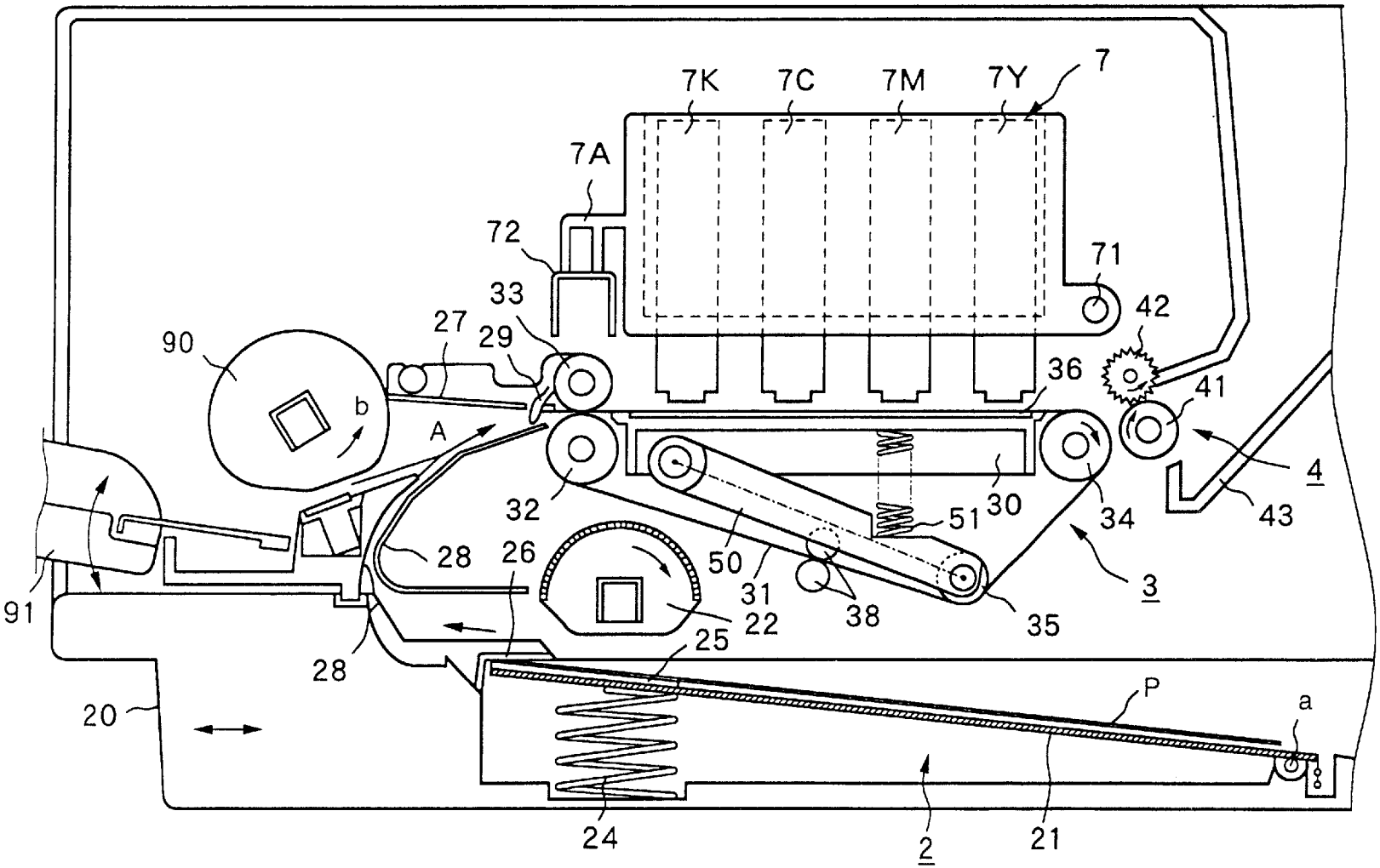
FIG. 1 is a sectional view showing the overall arrangement of an ink-jet printing apparatus according to an embodiment of the present invention.
Figure 2:
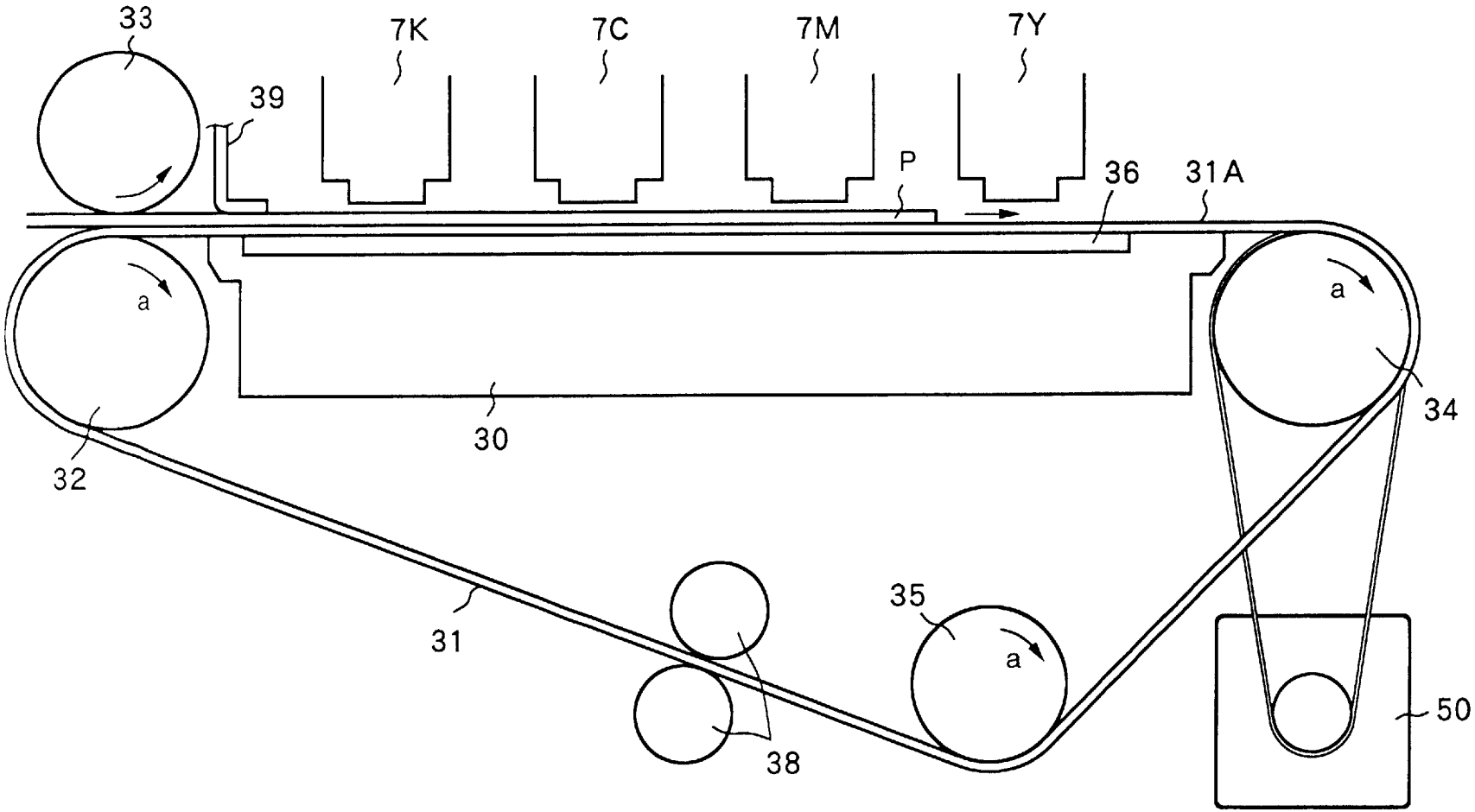
FIG. 2 is a sectional view showing the structure of a sheet convey section in the embodiment shown in FIG. 1.

FIGS. 1 and 2 are sectional views showing the internal structure of an ink-jet printing apparatus according to a preferred embodiment of the present invention, in which FIG. 1 is a sectional view showing the overall arrangement of the printing apparatus, and FIG. 2 is a sectional view showing the structure of a sheet convey section 3 of the printing apparatus.

The printing apparatus of this embodiment has an automatic sheet feeder, and comprises a sheet feed section 2, sheet convey section 3, exhaust section 4, and print head section 7. An outline of the printing apparatus will be explained in turn below in units of these sections. (I) Sheet Feed Section, (II) Sheet Convey Section, (III) Print Head Section, and (IV) Exhaust Section will be described in turn using FIGS. 1 and 2.

(I) Sheet Feed Section

The sheet feed section 2 is constructed by attaching a pressing plate 21 on which print paper sheets P as print medium are stacked, and a rotary sheet feed member 22 for feeding a print paper sheet P to a base 20. The pressing plate 21 is rotatable about a rotation shaft a which is coupled to the base 20, and is biased against the rotary sheet feed member 22 by a pressing plate spring 24. A separation pad 25 which is formed of a material having a large coefficient of friction such as synthetic leather or the like is provided on the pressing plate 21 at a position opposing the rotary sheet feed member 22 so as to prevent multiple feed of print paper sheets P. Furthermore, the base 20 has a separation pawl 26 which covers a corner of print paper sheets P in one direction, and separates print paper sheets one by one, and a release cam (not shown) for releasing a contact between the pressing plate 21 and rotary sheet feed member 22.

In the above structure, the release cam presses the pressing plate 21 down to a predetermined position in a standby state. As a result, the contact between the pressing plate 21 and rotary sheet feed member 22 is released. In this state, when the driving force of a convey roller 32 is transmitted to the rotary sheet feed member 22 and release cam via gears and the like, the release cam separates from the pressing plate 21, which moves upward, and the rotary sheet feed member 22 is brought into contact with a print paper sheet P. Upon rotation of the rotary sheet feed member 22, the print paper sheet P is picked up and begins to be fed. The print paper sheet P is separated by the separation pawl 26 one by one, and is fed to the sheet convey section 3. The rotary sheet feed member 22 rotates until it feeds the print paper sheet P into the sheet convey section 3, and the standby state in which the contact between the print paper sheet P and rotary sheet feed member 22 is released is set again, thus turning off the driving force from the convey roller 32.

Reference numeral 90 denotes a rotary sheet feed member used when a sheet is manually inserted. A print paper sheet P set on a manual insert tray 91 is picked up by the rotary sheet feed member 90 in accordance with a print command signal from a computer, and is conveyed to the convey roller 32.

(II) Sheet Convey Section

The sheet convey section 3 has a conveyor belt 31 which attracts and conveys a print paper sheet P, and a PE sensor (not shown). The conveyor belt 31 is driven by a driving roller 34, and is supported by the convey roller 32 and a pressure roller 35 as driven rollers so as to form a loop.

A pinch roller 33 which is driven by the conveyor belt 31 is provided at a position opposing the convey roller 32 to be in contact with the conveyor belt 31. The pinch roller 33 is pressed against the conveyor belt 31 by a spring (not shown) to guide a print paper sheet P to a print section. Furthermore, upper and lower guides 27 and 28 which guide a print paper sheet P are provided at an entrance of the sheet convey section 3 that receives the print paper sheet P. The upper guide 27 has a PE sensor lever 29 which informs the PE sensor (not shown) of detection of the leading and trailing ends of a print paper sheet P. Furthermore, the print head section 7 for forming an image on the basis of image information is provided downstream of the convey roller 32 in the convey direction of a print paper sheet.

In the above structure, a print paper sheet P fed to the sheet convey section 3 is fed to a roller pair, i.e., the convey roller 32 and pinch roller 33 while being guided by the upper and lower guides 27 and 28. At this time, the PE sensor lever 29 detects the leading end of the incoming print paper sheet P, thus obtaining the print position of the print paper sheet P. The print paper sheet P is conveyed by rotating the conveyor belt 31 via the convey roller 32 by an ultrasonic motor to be described later.

(III) Print Head Section

The print head section 7 of this embodiment uses full-line ink-jet print heads each having an array of a plurality of nozzles each of which constitutes a print element extending in a direction perpendicular to the convey direction of a print paper sheet P. These heads are arranged at a given spacing in the order of 7K (black), 7C (cyan), 7M (magenta), and 7Y (yellow) from the upstream side of the convey direction of the print paper sheet P, and the print head section 7 is attached to a head holder 7A.

Each print head 7 can apply heat to ink within each nozzle using heaters or the like. The ink causes film boiling due to this heat, and is ejected from each nozzle of the print head 7 by a change in pressure caused by growth or shrinkage of bubbles resulting from the film boiling, thus forming an image on the print paper sheet P.

In this embodiment, the electrothermal transducer such as the heater is employed as an ink ejecting element which constitutes the print element with the nozzle. However, the ink ejecting element is not limited to this construction. For example, a piezoelectric element can also be employed as the ink ejecting element.

One end of the print head section 7 is pivotally supported by a shaft 71, and a projection 7A formed on the other end of the print head section 7 engages with a rail 72, thus defining a spacing (sheet spacing) between the nozzle surface and print paper sheet P.

Note that an ink tank that stores ink and each print head may be integrally formed to constitute an exchangeable ink cartridge. Alternatively, the ink tank and print head may be independently arranged, and when ink is used up, the ink tank alone may be exchanged.

(IV) Exhaust Section

The exhaust section 4 is comprised of an exhaust roller 41 and spur 42. A print paper sheet P that has undergone image formation in the print section is conveyed while being clamped between the exhaust roller 41 and spur 42, and is exhausted onto an exhaust tray 43.

The arrangement and operation of attractive convey in the print section will be explained below using FIGS. 1 and 2.

Reference numeral 31 denotes a conveyor belt which moves while attracting and holding a print paper sheet P, is made up of a synthetic resin such as polyethylene, polycarbonate of about 0.1 to 0.2 mm, and has an endless belt shape. Reference numeral 36 denotes an attractive force generation means, which is fixed at a position opposing the print head section 7, and applies a voltage of around 0.5 kV to 10 kV to generate an attractive force on the conveyor belt 31 corresponding to the print region of the print head section 7. The attractive force generation means 36 is connected to a high-voltage power supply (not shown) that generates a predetermined high voltage.

As described above, reference numerals 32, 34, and 35 denote rollers which support the conveyor belt 31 and give an appropriate tension to that belt. The roller 34 is coupled to a sheet feed motor 50. A sheet pressing member 39 as pressing means for pressing the print paper sheet P against the conveyor belt side is attached to have a rotation shaft of the pinch roller 33 as the center of rotation, and is biased toward the conveyor belt 31 by a biasing means (not shown). The sheet pressing member 39 is formed of a conductive metal plate.

Reference numeral 38 denotes a pair of cleaning rollers which pinch the belt 31, and can absorb ink to remove soil such as ink attached to the belt 31. Also, these rollers 38 are formed of open cell sponge having a small cell diameter (preferably 10 $\mu$m to 30 $\mu$m) to prevent poor durability.

Operation will be explained below.

A print paper sheet P is guided to the print section while being clamped between the pinch roller 33 and conveyor belt 31, and enters an attractive force generation portion while being pressed against the conveyor roller 31 by the sheet pressing member 39. The print paper sheet P is attracted by a flat portion of the conveyor belt 31 by an attractive force supplied from the attractive force generation means 36, and is conveyed in the direction of an arrow a by the sheet feed motor 50 and roller 34 while undergoing the print process by the print head section. At this time, since the conveyor belt 31 that holds the print paper sheet P no member protruding toward the print head section 7 upon printing on the leading and trailing end portions of the print paper sheet P, the print process can be done while the ejection nozzles at the end portion of the print head section and the end portion of the print paper sheet P are close to each other, thus obtaining a high-precision print image.

When ink is ejected in large quantity on the print paper sheet P, the print paper sheet P swells and cockles. In this case, since the print paper sheet P is attracted on the conveyor belt 31 by the attractive force of the attractive force generation means 36 and the pressing force of the sheet pressing member 39, the print paper sheet P can be prevented from floating toward the head section 7. Therefore, the head section 7 does not contact the print paper sheet P, thus allowing a stable print process. Even when the end portion of the print paper sheet P cockles or curls due to changes in environment including temperature, humidity, or the like, the sheet pressing member 39 can press the print paper sheet P against the conveyor belt 31, and can convey it to the attractive force generation portion while removing cockling and curl, thus allowing stable attraction in the print section.

Figure 3:
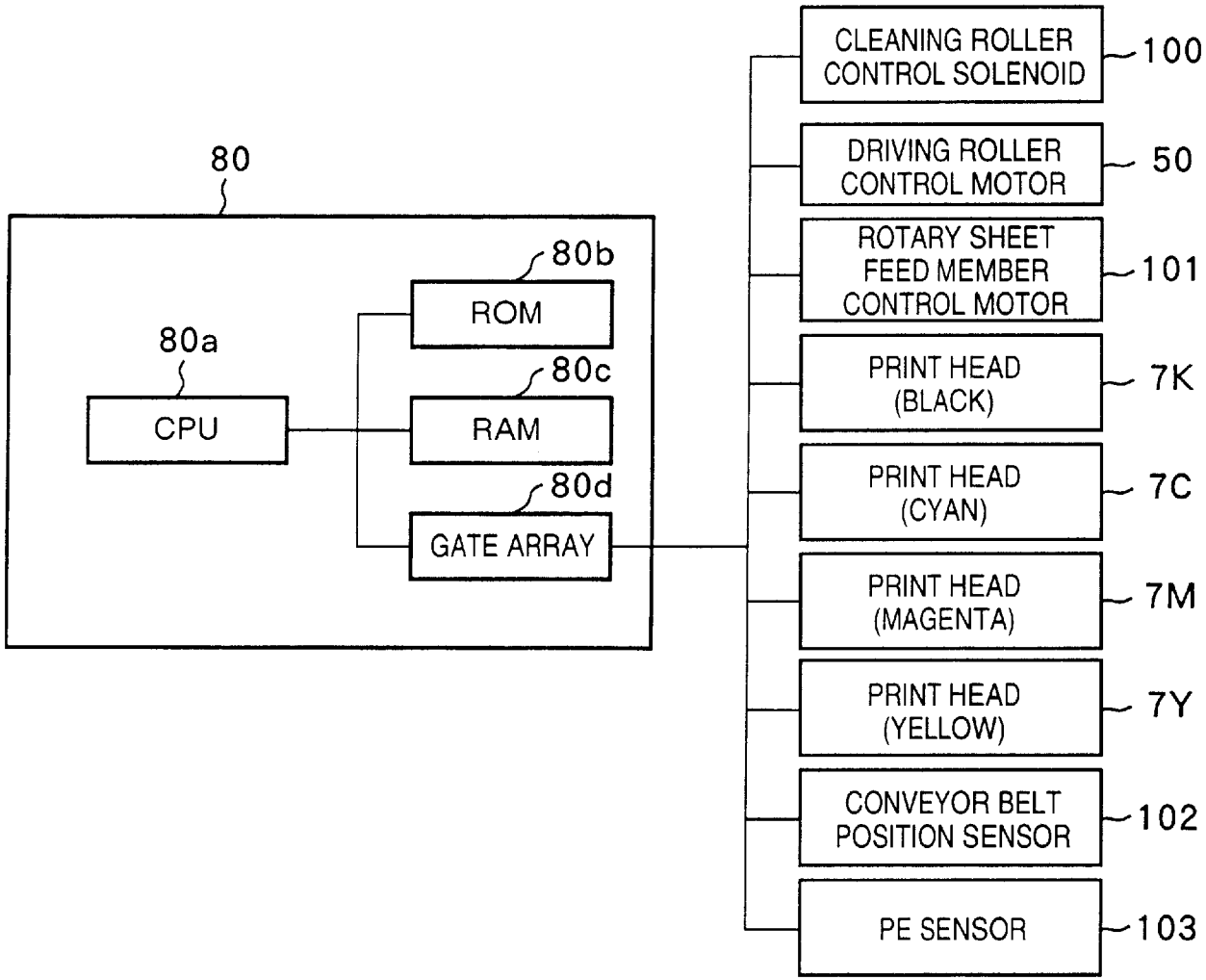
FIG. 3 is a block diagram showing the control arrangement of the embodiment shown in FIG. 1.

FIG. 3 is a block diagram showing the arrangement of a controller of the ink-jet printing apparatus according to the present invention, and devices controlled by the controller.

Reference numeral 7K denotes a black print head; 7C, a cyan print head; 7M, a magenta print head; and 7Y, a yellow print head. Reference numeral 100 denotes a solenoid for controlling the cleaning rollers. Reference numeral 50 denotes a motor for controlling the driving roller which drives the conveyor belt. Reference numeral 102 denotes a sensor for detecting a reference position of the conveyor belt. Reference numeral 103 denotes a sensor for detecting the paper end of the print sheet. The sensor 103 is connected to the PE sensor lever 29.

Note that the conveyor belt position sensor 102 is provided on the back surface side of the conveyor belt at a position between the convey roller 32 and pressure roller 35 although it is not shown in FIGS. 1 and 2.

Reference numeral 80 denotes a controller. Reference numeral 80*a* denotes a CPU; 80*b*, a ROM for storing a program; 80*c*, a work memory required for control; and 80*d*, a gate array. These components 80*a* to 80*d* are connected to each other via a system bus. The gate array 80*d* outputs control signals for the driving roller motor and rotary sheet feed member motor 101, a control signal for the cleaning roller solenoid, an image signal to the print heads, and a control signal for the print heads, and reads information from a sensor for detecting soil on the conveyor belt and the PE sensor.

Figure 4A:
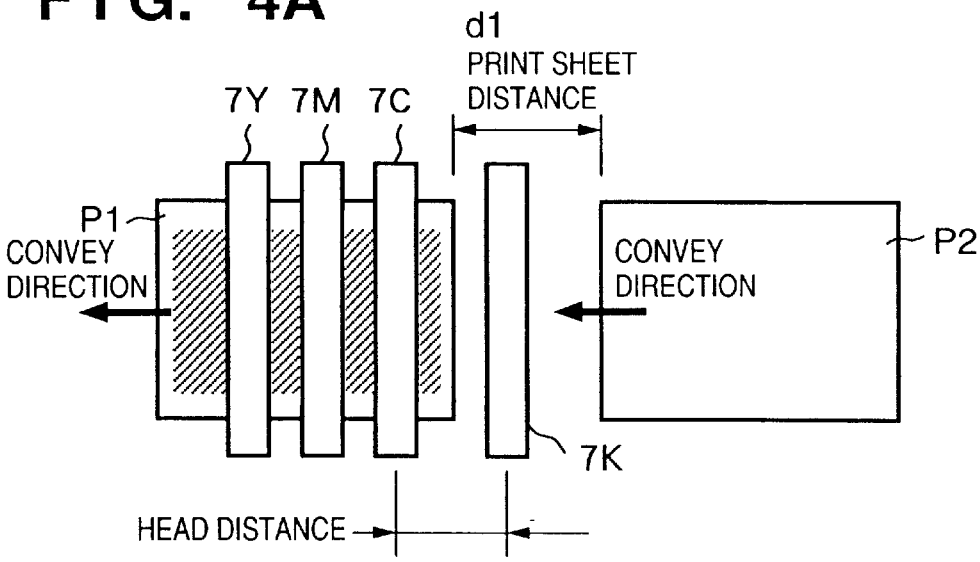
FIGS. 4A to 4C are views showing the positional relationship between the print head and print sheet in the embodiment shown in FIG. 1.
Figure 4B:
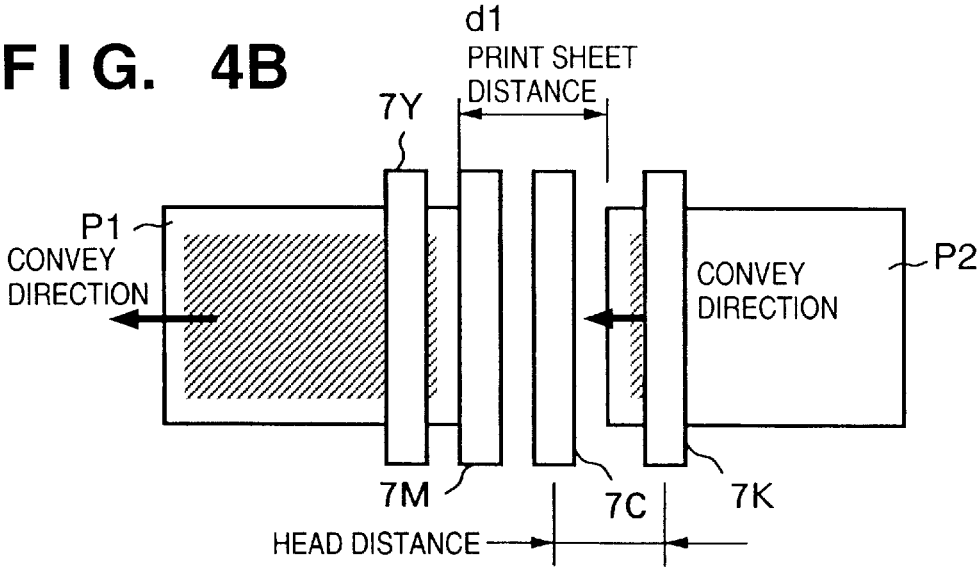
Figure 4C:
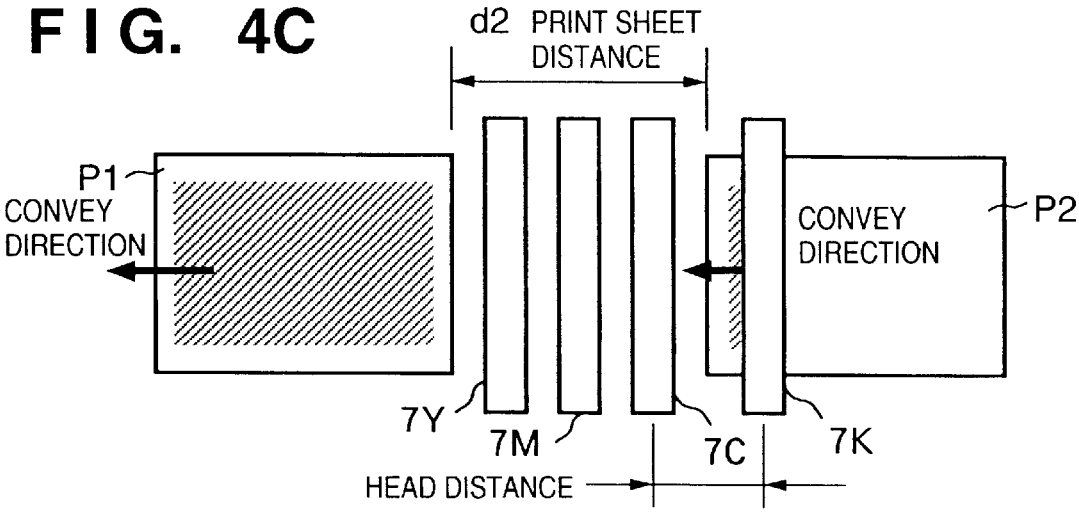

FIGS. 4A to 4C show the print processes on a print paper sheet conveyed by the conveyor belt 31 in the ink-jet printing apparatus of this embodiment. As shown in FIGS. 4A to 4C, the number of print heads to be driven simultaneously changes depending on the positional relationship between print paper sheets P1 and P2, and the print heads.

For example, in FIG. 4A, since the print heads 7C, 7M, and 7Y are located above the conveyed print paper sheet P1, the number of print heads to be driven simultaneously is 3. On the other hand, in FIG. 4B, the print heads 7K and 7Y are respectively located above the print paper sheets P1 and P2, and other print heads fall outside these print paper sheets. Therefore, the number of print heads to be driven simultaneously is 2. In this manner, the number of print heads to be simultaneously driven changes along with an elapse of time depending on the position of the print paper sheet relative to the print heads.

In FIG. 4C, a print sheet distance d2 as the distance between two print paper sheets P1 and P2 to be conveyed successively is larger than a print sheet distance d1 shown in FIGS. 4A and 4B. As a result, the positional relationship between the print head 7K and print paper sheet P2 is the same as that in FIG. 4B, but the positional relationship between the print head 7Y and print paper sheet P1 is different from FIG. 4B, i.e., the print head 7Y falls outside the print paper sheet P1 like the print heads 7C and 7M. For this reason, the number of print heads to be driven simultaneously is only one. In this manner, the number of print heads to be driven simultaneously also changes depending on the print sheet distance.

Figure 5A:
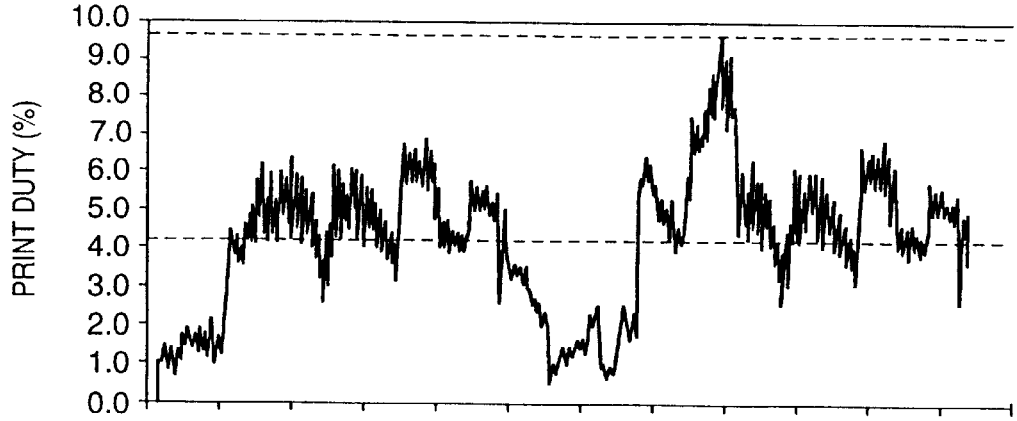
FIGS. 5A to 5C are graphs showing a change in print duty with respect to the print sheet distance in the embodiment shown in FIG. 1.
Figure 5B:
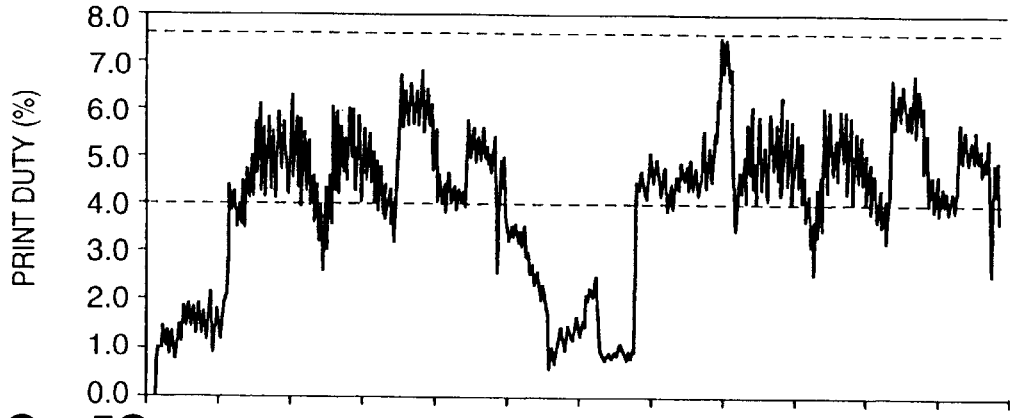
Figure 5C:
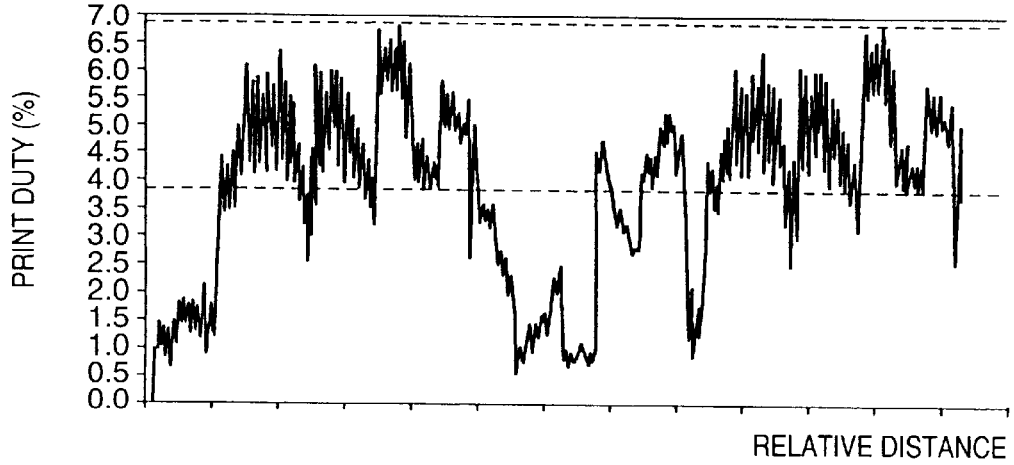

FIGS. 5A to 5C are graphs showing a change in print duty when a predetermined print image is successively printed on two pages in the ink-jet printing apparatus of this embodiment. In FIGS. 5A to 5C, the ordinate plots the print duty (%), and the abscissa plots the relative position (raster) from the leading end of the print paper sheet with reference to the print head 7K. Note that the print duty is the ratio of the number of nozzles to be actually driven to the total number of nozzles of all the print heads of the ink-jet printing apparatus.

FIGS. 5A, 5B, and 5C respectively show the print duties when the print sheet distances of 60 mm, 80 mm, and 100 mm are set. The maximum values of the print duties are respectively 9.6%, 7.6%, and 6.8%. That is, even when the print image to be printed remains the same, the maximum value of the print duty changes largely if the print sheet distance changes.

In this embodiment, the power supply load of the printing apparatus is controlled to become equal to or smaller than a predetermined value by exploiting the relationship between the print sheet distance and print duty.

The print sheet distance control method for the ink-jet printing apparatus of this embodiment will be described below using the flow charts shown in FIGS. 6 and 7.

Figure 6:
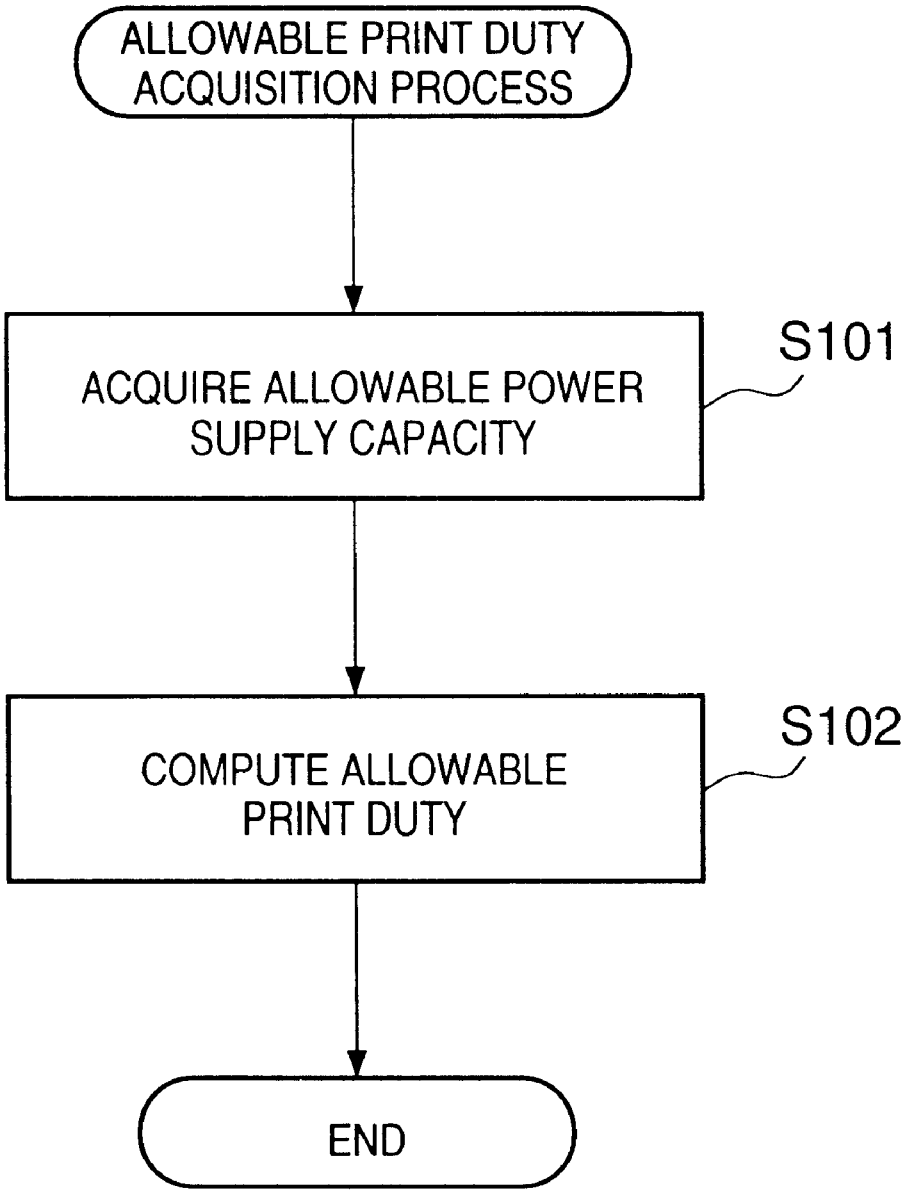
FIG. 6 is a flow chart showing an allowable print duty acquisition process in the embodiment shown in FIG. 1.

Prior to a print process, an allowable print duty acquisition process shown in FIG. 6 is launched to acquire an allowable print duty, which represents the print duty that allows the print process using the built-in power supply of the ink-jet printing apparatus.

In the allowable print duty acquisition process, an allowable electric power capacity that the built-in power supply of the ink-jet printing apparatus can supply to drive the print heads is read out from the ROM 80B (step S101). Then, the allowable print duty is computed based on consumption power per ejection nozzle of the print head, and the total number of nozzles of all the print heads and is saved in the memory 80*c* (step S102).

Figure 7:
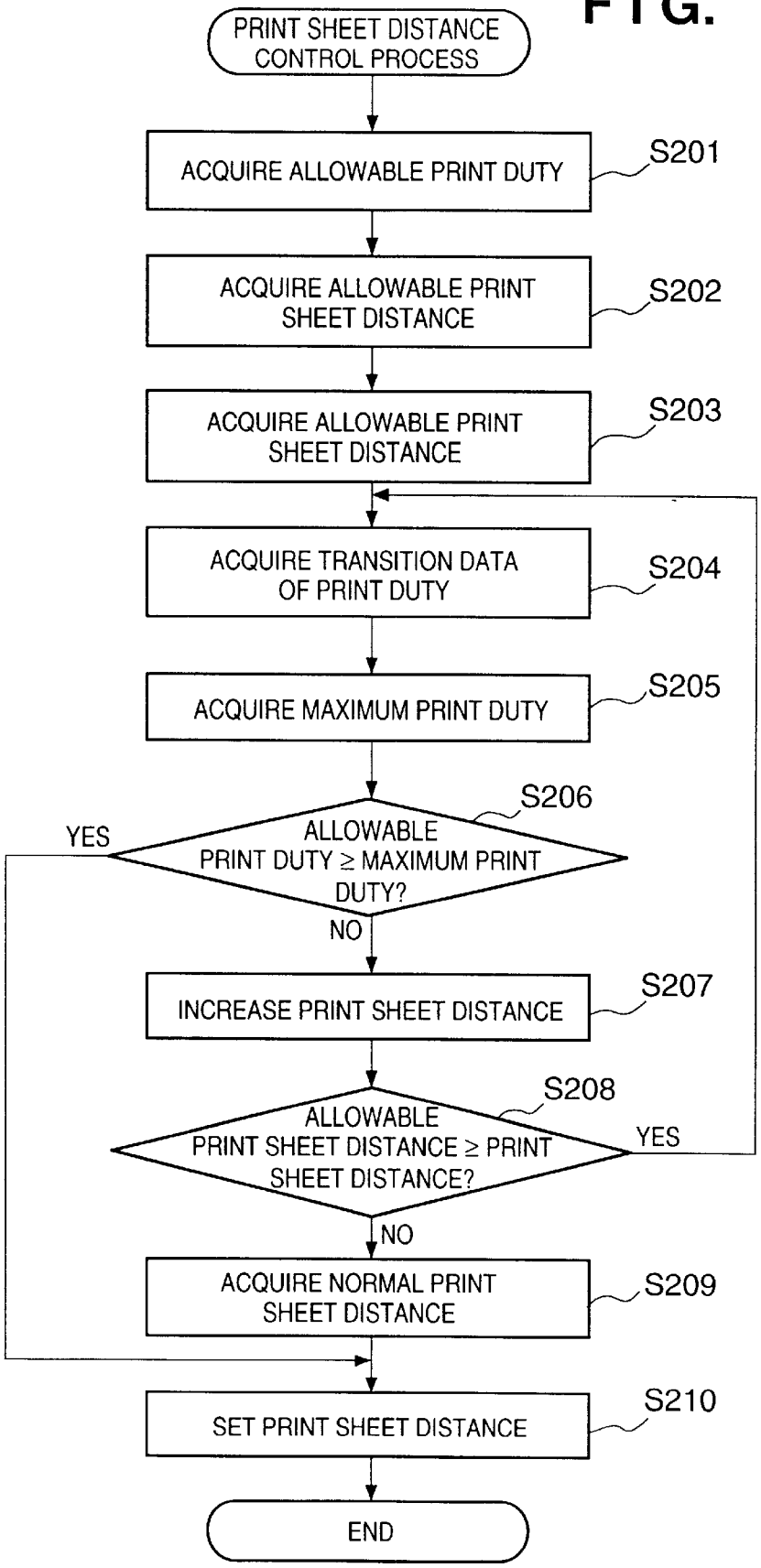
FIG. 7 is a flow chart showing a print sheet distance control process in the embodiment shown in FIG. 1.

The print sheet distance control process shown in FIG. 7 is launched during the print process of an image, which starts in response to a print request from the host. As for the timing, this process is launched when all next print images to be printed are stored in the memory 80*c* of the ink-jet printing apparatus in a printable data format, and a print paper sheet on which the print images are printed has reached the position of a registration roller immediately before it is supplied to the conveyor belt 31. The registration roller (not shown) is disposed upstream from the pinch roller 33, and is used to adjust the supply timing of a print paper sheet to the conveyor belt 31.

Initially, the allowable print duty saved by the allowable print duty acquisition process is read out from the memory 80*c* (step S201). Subsequently, an allowable print sheet distance as a maximum value of the print sheet distance is acquired from the ROM 80*b* (step S202), and a normal print sheet distance is acquired from the ROM 80*b* (step S203).

Transition data of the print duty shown in FIGS. 5A to 5C is analyzed on the basis of the current print image, the next print image, and the acquired print sheet distance (step S204), and the maximum value of the print duty is extracted from this transition data and is set as a maximum print duty (step S205).

It is then checked if the acquired maximum print duty is equal to or smaller than the allowable print duty (step S206).

If the maximum print duty is equal to or smaller than the allowable print duty, since no problem is posed if the print process of the next page proceeds using the current print sheet distance, the current print sheet distance is saved in the memory 80*c* as information for the print sheet supply timing of the registration roller (step S210), thus ending the process. Note that the process for driving the registration roller and supplying a print paper sheet to the conveyor belt 31 is done by a sheet feed control process as another control program executed by the CPU 80*a*.

If it is determined in step S206 that the maximum print duty has exceeded the allowable print duty, the print sheet distance is increased by a predetermined length (step S207), and after it is confirmed that the new print sheet distance does not exceed the allowable print sheet distance acquired in step S202 (step S208), the flow returns to step S204. Then, the print sheet distance is increased by a predetermined length until the maximum print duty becomes equal to or smaller than the allowable print duty.

Upon setting the print sheet distance, more specifically, evaluation starts from the print sheet distance=60 mm to seek a condition that the print duty becomes equal to or smaller than the allowable print duty while increasing the print sheet distance to 80 mm, 100 mm, and the like.

If the condition that the print duty becomes equal to or smaller than the allowable print duty cannot be found even after the processes in steps S204 to S208 are repeated, the print sheet distance eventually becomes larger than the allowable print sheet distance in step S208. In this case, a normal print sheet distance is read out from the ROM 80*b* (step S209), and is saved in the memory 80*c* so that it can be used in determination of the print paper sheet supply timing in the sheet feed control process (step S210), thus ending the process.

In this embodiment, control programs and data stored in the ROM 80*b* are loaded onto the memory 80*c* upon execution. Alternatively, control programs and data recorded on a storage medium such as a flexible disk or the like may be recorded from a host computer 112*a* to which an external storage device 112*b* is connected to a flash ROM 80*b* provided to an ink-jet printing apparatus 112*c*, and may then be loaded from the flash ROM 80*b* onto the memory 80*c*.

Figure 8:
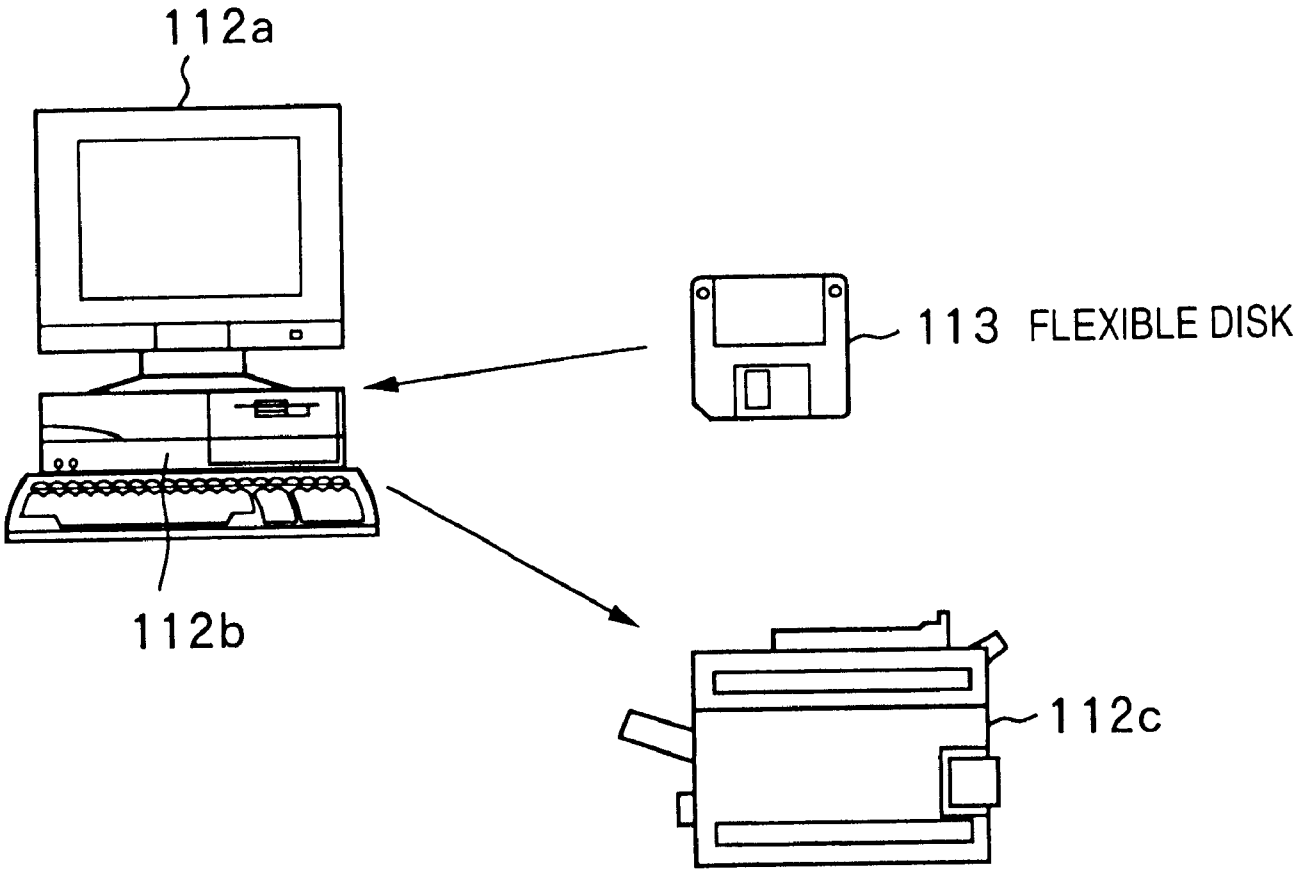
FIG. 8 is a view exemplifying a method of supplying a control program and data to the ink-jet printing apparatus of the present invention.

FIG. 8 shows a case wherein a flexible disk drive is used as the external storage device 112*b* connected to the host computer 112*a*, and control programs and data are stored in a flexible disk 113.

In this case, a storage medium that stores the control programs and data is not limited to the flexible disk, but may be a CD-ROM, IC memory card, and the like.

Figure 9:
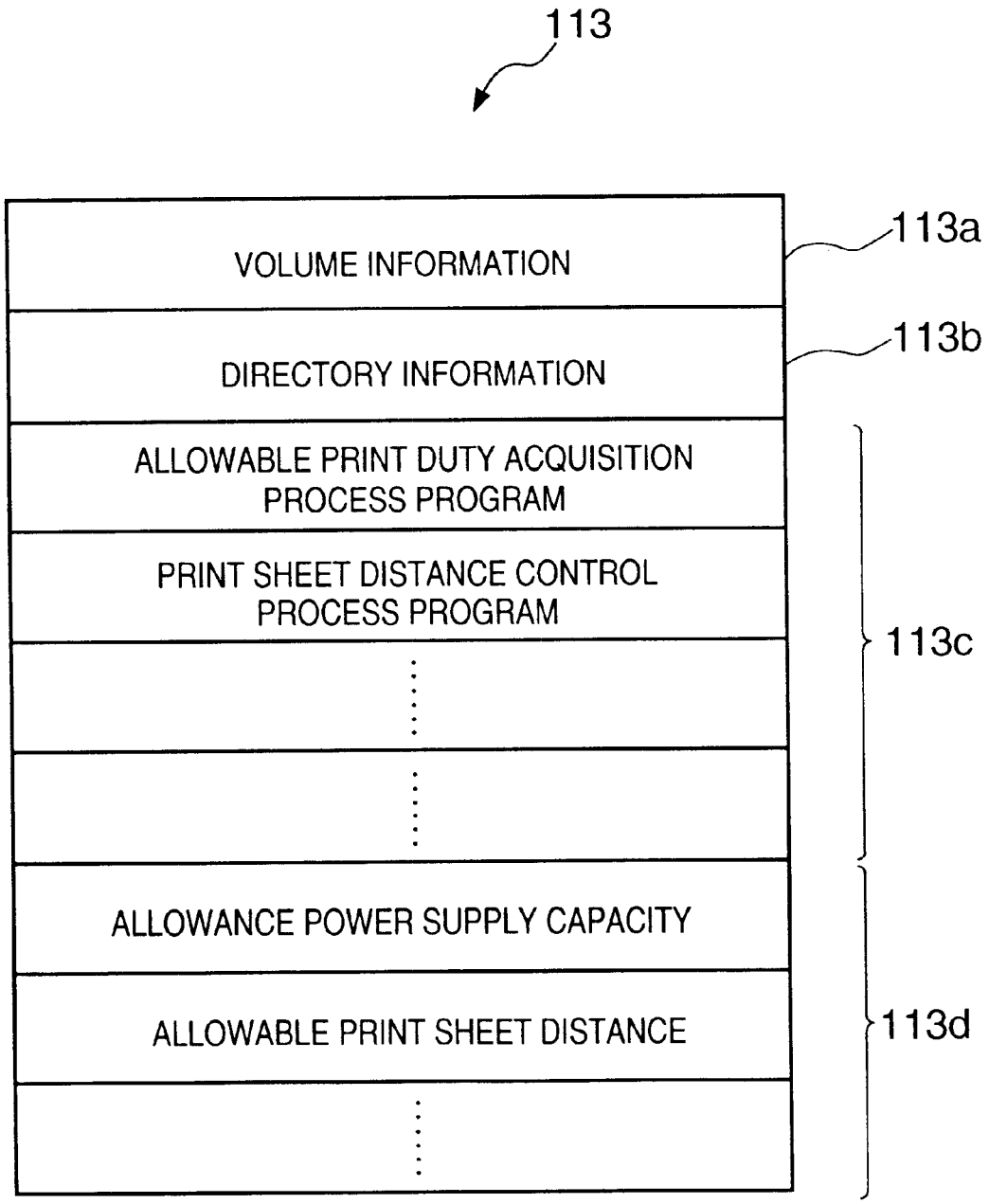
FIG. 9 shows a memory map of an external storage medium that supplies control program and data to the ink-jet printing apparatus of the present invention.

FIG. 9 shows a memory map when the flexible disk 113 is used as the storage medium for storing the control programs and data.

The memory map has a volume information storage area 113*a,* a directory information storage area 113*b,* a control program storage area 113*c* for storing predetermined control programs (the allowable duty acquisition process program, print sheet distance control program, and the like), and a data storage area 113*d* for storing data (the allowable power supply capacity, allowable print sheet distance, the number of nozzles of the print heads, and the like) used in these control programs.

The flexible disk 113 with such memory map is read by the flexible disk drive 112*b* connected to the host computer 112*a* to download the control programs and data to the ink-jet printing apparatus.

According to the aforementioned embodiment of the present invention, a stable print process can be done even using a low-cost power supply without any deterioration of print quality and extreme drop of the print speed.

Note that the present invention is not limited to the above embodiment, and various modifications and changes may be made. Some modifications will be explained below.

In the first modification, the number of nozzles used as a reference upon acquiring the allowable print duty is computed in correspondence with the actual print region width.

More specifically, in the aforementioned embodiment, a computation is made with reference to the total number of nozzles of the print heads upon acquiring the allowable print duty. In most cases, the ink-jet printing apparatus does not print on the entire surface of a print sheet having a maximum size, and the region to be printed is normally smaller than the print sheet size or a print sheet size is smaller than the maximum sheet. For this reason, in case of the full-line print head, the number of nozzles normally used in a print process is smaller than the total number of nozzles of the print heads.

Hence, the step of computing the number of nozzles used as a reference upon computing the allowable print duty (to be referred to as the reference number of nozzles) on the basis of the print size and effective print region, and setting the reference number of nozzles to a value that matches an actual print process is added immediately before step S102 in FIG. 6.

In this case, when the allowable print duty acquisition process is launched every time a print request is acquired, the reference number of nozzles can be set to be a value that matches an actual print request every time the print request is sent. Hence, a high-speed print process can be done while effectively using electric power that can be supplied.

In the second modification, a plurality of allowable print duties computed in advance are stored so as to shorten the computation time of the allowable print duty.

In the aforementioned embodiment, the allowable print duty is computed before the print process starts. In order to shorten the processing time and the like associated with this computation, values computed in advance may be stored in the ROM 80*b*.

In this case, if the allowable print duty is changed in correspondence with the actual print region width like in the first modification, a table that stores some print region widths and a plurality of allowable print duties computed in advance in correspondence with each other may be recorded in the ROM 80*b*.

In the third modification, the print sheet distance is controlled in correspondence with the number of print heads used in a print process.

In the aforementioned embodiment, the allowable print sheet distance is set as a fixed value that can be read out from the ROM 80*b*. In some cases, however, the number of print heads used in a print process is limited depending on a print image or print mode. For example, upon printing a monochrome image, only one print head 7K is used. If a color print process is done using only three color inks, only the three print heads 7C, 7M, and 7Y are used.

In this manner, when the number of print heads to be used changes, the print sheet distance, which sets the number of print heads to be driven simultaneously to 1, changes the timing across two print paper sheets, as shown in FIG. 4C.

In such case, the step of correcting the allowable print sheet distance depending on a print image and print mode is added immediately after step S203 in FIG. 7, so as to optimize the print sheet distance.

With this arrangement, even when a print image or print mode changes, appropriate print sheet distance control can be achieved.

In the above embodiment, the print sheet is employed as a print medium. However, the print medium for the present invention is not limited to the print sheet. For example, an OHP sheet or a woven fabric can be employed as a print medium.

In the above embodiment, droplets discharged from the printing head are ink droplets, and a liquid stored in the ink tank is ink. However, the liquid to be stored in the ink tank is not limited to ink. For example, a treatment solution to be discharged onto a printing medium so as to improve the fixing property or water resistance of a printed image or its image quality may be stored in the ink tank.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand type and continuous type systems. Particularly, in the case of the on-demand type, the system is effective because, by applying at least one driving signal, which corresponds to printing information and gives a rapid temperature rise exceeding nucleate boiling, to each of the electrothermal transducers arranged in correspondence with a sheet or with liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full-line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit, but also a cartridge type printing head in which an ink tank is integrally arranged on the printing head itself, can be applicable to the present invention.

It is preferable to add recovery means for the is printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only can a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in the above-mentioned embodiment of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a nonuse state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the recording apparatus of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments being realized by executing the program codes which are read by a computer, the present invention includes a case where an OS (operating system) or the like working on the computer performs a part of or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

If the present invention is realized as a storage medium, program codes corresponding to the above mentioned flowcharts (FIG. 6 and/or FIG. 7) are to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus having a plurality of full-line print heads each having a print element array corresponding to a width of a print medium, comprising:

convey means for conveying the print medium to a position where the print heads can print;

print electric power computation means for computing a numerical value that pertains to electric power to be supplied to the print heads upon printing print data when print data that uses a plurality of print media is received;

determination means for determining if the numerical value that pertains to the electric power is larger than a predetermined value;

distance setting means for setting a distance between the plurality of print media in accordance with the determination by said determination means; and convey control means for controlling said convey means to make the distance between the print media be the distance set by said distance setting means upon conveying the plurality of print media.

2. The apparatus according to claim 1, wherein the distance setting means sets the distance between the plurality of print media to make the numerical value that pertains to the electric power equal to or smaller than the predetermined value when said determination means determines that the numerical value that pertains to the electric power is larger than the predetermined value.

3. The apparatus according to claim 1, wherein the numerical value that pertains to the electric power is a ratio of the number of print elements to be driven upon printing the print data to the number of all the print elements of the print heads.

4. The apparatus according to claim 1, wherein said distance setting means selects and sets the distance between the print media from a plurality of pre-set values.

5. The apparatus according to claim 1, further comprising means for changing the predetermined value in correspondence with a size of the print medium and a print region of the print data.

6. The apparatus according to claim 5, further comprising table creation means for storing the predetermined value corresponding to the size of the print medium and the print region of the print data.

7. The apparatus according to claim 1, further comprising memory means for storing the print data in units of pages, and wherein said print electric power computation means computes the numerical value that pertains to the electric power when print data of the next page to be printed is stored in said memory means.

8. The apparatus according to claim 1, wherein each of the print heads is an ink-jet print head for printing by ejecting ink from print elements.

9. The apparatus according to claim 8, wherein each of the print heads is a print head which ejects ink using heat energy, and comprises a heat energy converter for generating heat energy to be applied to the ink.

10. A power supply load reduction method for a printing apparatus having a plurality of full-line print heads each having a print element array corresponding to a width of a print medium, comprising:

a convey step of conveying the print medium to a position where the print heads can print;

a print electric power computation step of computing a numerical value that pertains to electric power to be supplied to the print heads upon printing print data when print data that uses a plurality of print media is received;

a determination step of determining if the numerical value that pertains to the electric power is larger than a predetermined value;

a distance setting step of setting a distance between the plurality of print media in accordance with the determination in said determination step; and a convey control step of controlling the convey step to make the distance between the print media be the distance set in the distance setting step upon conveying the plurality of print media.

11. The method according to claim 10, wherein the distance setting step sets the distance between the plurality of print media to make the numerical value that pertains to the electric power equal to or smaller than the predetermined value when it is determined in the determination step that the numerical value that pertains to the electric power is larger than the predetermined value.

12. The method according to claim 10, wherein the numerical value that pertains to the electric power is a ratio of the number of print elements to be driven upon printing the print data to the number of all the print elements of the print heads.

13. The method according to claim 10, wherein the distance setting step includes the step of selecting and setting the distance between the print media from a plurality of pre-set values.

14. The method according to claim 10, further comprising a step of changing the predetermined value in correspondence with a size of the print medium and a print region of the print data.

15. The method according to claim 14, further comprising a table creation step of storing the predetermined value corresponding to the size of the print medium and the print region of the print data.

16. The method according to claim 10, further comprising a memory step of storing the print data in units of pages, and wherein the print electric power computation step includes a step of computing the numerical value that pertains to the electric power when print data of a next page to be printed is stored in the memory step.

17. A storage medium which stores a power supply load reduction method for a printing apparatus having a plurality of full-line print heads each having a print element array corresponding to a width of a print medium, said storage medium storing program codes which respectively implement:

a convey step of conveying the print medium to a position where the print heads can print;

a print electric power computation step of computing a numerical value that pertains to electric power to be supplied to the print heads upon printing print data when print data that uses a plurality of print media is received;

a determination step of determining if the numerical value that pertains to the electric power is larger than a predetermined value;

a distance setting step of setting a distance between the plurality of print media in accordance with the determination in the determination step; and a convey control step of controlling the convey step to make the distance between the print media be the distance set in the distance setting step upon conveying the plurality of print media.

* * * * *